US008379896B2

(12) United States Patent
Hibbing et al.

(10) Patent No.: US 8,379,896 B2
(45) Date of Patent: Feb. 19, 2013

(54) POWER SUPPLY DEVICE FOR A MICROPHONE

(75) Inventors: Manfred Hibbing, Wedemark (DE); Tom-Fabian Frey, Braunschweig (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 326 days.

(21) Appl. No.: 12/773,643

(22) Filed: May 4, 2010

(65) Prior Publication Data

US 2010/0290649 A1 Nov. 18, 2010

(30) Foreign Application Priority Data

May 5, 2009 (DE) ..... 10 2009 019 707

(51) Int. Cl.
*H04R 25/00* (2006.01)

(52) U.S. Cl. ..... 381/323; 360/13

(58) Field of Classification Search ..... 381/323, 381/113, 122; 360/13, 63
See application file for complete search history.

(56) References Cited

U.S. PATENT DOCUMENTS 5,225,944 A * 7/1993 Takao ..... 360/13
5,577,129 A * 11/1996 Ehara ..... 381/113
2005/0134384 A1* 6/2005 Sato ..... 330/277

* cited by examiner

*Primary Examiner* — Fan Tsang
*Assistant Examiner* — Eugene Zhao
(74) *Attorney, Agent, or Firm* — Kilpatrick Townsend & Stockton LLP

(57) ABSTRACT

The present invention concerns a feed device for feeding a microphone with a dc voltage. The feed device has first, second and third terminals (a, b, c), a resistor arrangement having at least a one resistor (R1-R3) and a dc voltage source (11) for providing a feed voltage. In that case the resistor arrangement is disposed between the dc voltage source (11) and the first and second terminals (a, b). In addition the feed device has a measuring device and a control device (4). The measuring device detects a dc voltage between the first and second terminals and the third terminal, and the control device (4) reduces or increases the ohmic resistance of the resistor arrangement and the feed voltage of the dc voltage source (11).

16 Claims, 2 Drawing Sheets

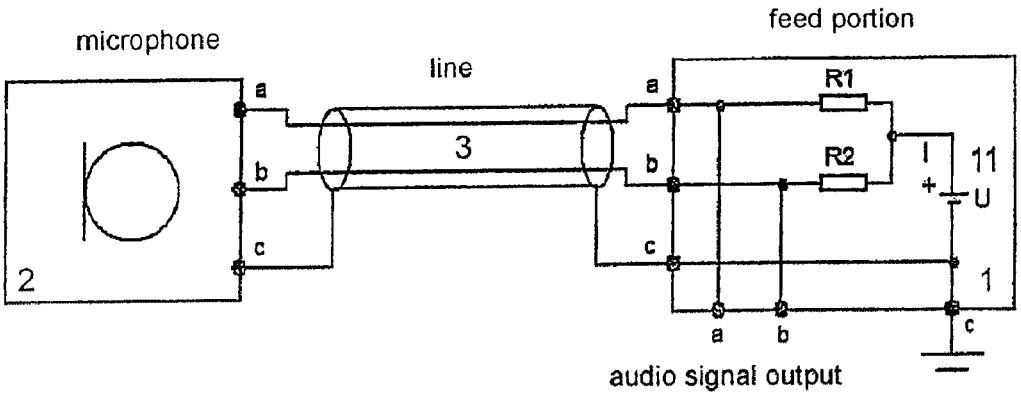
Fig. 1 (state of the art)
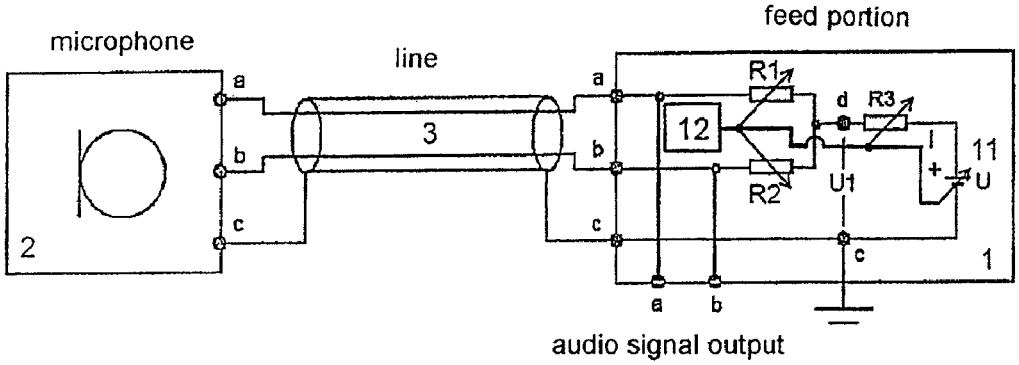
Fig. 2

POWER SUPPLY DEVICE FOR A MICROPHONE

The invention concerns a feed device for feeding a microphone, in particular a capacitor microphone.

BACKGROUND

Microphones serve to convert sound signals into corresponding electrical ac voltage signal. Those ac voltage signals are referred to as microphone signals. The microphone signals are transmitted from the microphone by way of lines for example to amplifiers or mixer desks.

To provide the power supply for microphones a direct current can be transmitted in the opposite direction to the microphone signal. For that purpose a dc voltage is applied to the same lines as those on which the ac voltage signal is transmitted from the microphone. In the case of capacitor microphones such a power supply is referred in audio technology as the phantom feed. The power supply for the capacitor microphones serves inter alia to drive the impedance converter in the microphone. It can also be used for polarization of the capacitor converter contained in the microphone.

FIG. 1 shows a diagrammatic circuit illustrating the principle of a microphone having a phantom feed in accordance with DIN 61938 (up to 1979 DIN 45596). In that respect FIG. 1 shows a feed portion 1 connected to a microphone 2 by way of a line 3. The line 3 has at least two line wires a and b, on which the ac voltage signal produced by the microphone 2 is transmitted to the feed portion 1, as well as a screen c also connected to the feed portion 1 and the microphone 2. The ac voltage signal is made available for example for further use at the feed portion 1, by way of the audio signal outputs a and b. The feed portion 1 can be connected to ground by way of a grounding terminal c.

In addition in the feed portion 1 there is a dc voltage source 11 which provides a feed voltage U. In that respect one pole of the dc voltage source 11 is connected to the screen c and the other pole of the dc voltage source 11 is connected to two resistors R1 and R2 arranged in mutually parallel relationship. The resistors R1 and R2 are respectively connected to one of the two line wires a and b. The audio signal outputs a and b at the feed portion 1 are connected directly to the terminals of the line wires a and b and the two resistors R1 and R2. The resistors R1 and R2 are also referred to as feed resistors.

The two resistors R1 and R2 have ohmic resistances which are as identical as possible. In that way the operating current I flows in respective halves thereof from the dc voltage source 11 of the feed portion 1 by way of the two resistors R1 and R2 and the line wires a and b of the line 3 to the microphone 2. In that case there is an identical dc voltage in relation to the screen c at the line wires a and b, and for that reason direct current transmission on the line wires a and b does not influence the ac voltage signal transmission of the microphone signal. The resistors R1 and R2 should have resistances which are as far as possible of the same value in order to ensure low-interference signal conduction by circuitry symmetry. In addition the resistors R1 and R2 serve for decoupling the audio signal generated by the microphone 2 from the dc voltage source.

A number of examples of a phantom feed are set out as standards in DIN 61938. In that respect, the feed voltages U, feed currents I and feed resistors R1 and R2 are established in accordance with Table 1 for the basic circuitry shown in FIG. 1. In practice the feed voltage of 48 V (phantom feed P 48) is widespread.

TABLE 1

| Standard values of the phantom feed in accordance with DIN 61938 | | | |
|---|---|---|---|
| Feed voltage U | 12 ± 1 V | 24 ± 4 V | 48 ± 4 V |
| Feed current I | max. 15 mA | max. 10 mA | max. 10 mA |
| R1 and R2 | 680 Ω | 1.2 Ω | 6.8 kΩ |

The diagrammatic basic circuit shown in FIG. 1 suffers from the disadvantage that the operating current of the microphone 2 at the feed resistors R1 and R2 leads to a power loss which has to be additionally applied by the feed voltages 11 and which is converted into heat in the feed resistors R1 and R2.

That becomes clear in particular in the case of a phantom feed involving 48 V if the microphone 2 consumes the maximum operating current of 10 mA, which is permissible in accordance with the standard. Then the total power to be applied in the basic circuit shown in FIG. 1 by the feed voltage source 11 is 0.48 W. Of that, 0.14 W is consumed by the microphone 2 while 0.34 W is converted into heat in the feed resistors R1 and R2. The ratio of useable power in the microphone 2 to the total power, that is to say the level of efficiency, is in that case only about 30%, that is to say the power supply must be oversized by a factor of about 3. The power to be additionally applied can considerably add up if a plurality of microphones 2 have to supplied at the same time. Also if the supply is from batteries or accumulators, the operating time is considerably reduced.

SUMMARY

The object of the invention is to reduce the power loss on the feed side of a microphone feed without adversely affecting operation of the fed microphone.

That object is attained by a feed device as set forth in claim 1 and by a method as set forth in claim 12.

The feed device for feeding a microphone with a dc voltage, comprises a first, a second and a third terminal, a resistor arrangement having at least one resistor, a dc voltage source for providing a feed voltage, wherein the resistor arrangement is disposed between the dc voltage source and the first and second terminals, a measuring device for detecting the dc voltage between the first and second terminals and the third terminal, and a control device for reducing the ohmic resistance of the resistor arrangement and the feed voltage of the dc voltage source.

An advantage of the feed device according to the invention is that the feed voltage can be adapted to the dc voltage source without in that case the dc voltage being altered at the terminal of the feed device. In that way the same operating voltage is always made available at the terminal of the feed device and thus the microphone, but a lower dc voltage is required for that purpose at the dc voltage source of the feed device, than in the case of known feed devices. In that way the power consumption of the feed device according to the invention can be reduced in relation to known feed devices, and the costs incurred thereby.

In accordance with an aspect of the present invention the resistor arrangement of the feed device has a first and a second resistor which are arranged in mutually parallel relationship and have the same ohmic resistance, and the control device of the feed device is adapted to slidingly reduce the ohmic resistances of the first and second resistors.

An advantage of the feed device is that the reduction in the resistances of the resistor arrangement and the feed voltage of the dc voltage source can take place in a sliding fashion. In that case the resistors and the dc voltage of the feed device are so altered by the control device so that the operating dc voltage at the microphone remains constant. That avoids interference at the microphone, which can be caused by a change in operating voltage. In particular pulse-like interference in the microphone and in the signal transmission from the microphone to the feed device can occur due to abrupt changes in the feed voltage. Such interference can be avoided by the smooth sliding transition from a standard feed to the operating mode which is modified in accordance with the invention.

In accordance with a further aspect of the invention the resistor arrangement of the feed device corresponds to the standard DIN 61938.

Thus it is possible to use a standard circuit so that the basic circuitry is known and it is only necessary to add thereto further elements and functions.

In accordance with an aspect of the present invention the resistor arrangement of the feed device has a third resistor arranged between the dc voltage source and the first and second resistors, and the control device is adapted to slidingly reduce the ohmic resistance of the third resistor.

The expansion of the resistor arrangement by a third resistor in series, the ohmic resistance of which can be reduced like the ohmic resistances of the first two resistors provides a further possible way of reducing the overall ohmic resistance of the resistor arrangement. In this case also the reduction in the ohmic resistance of the third resistor takes place in such a way that, with the feed voltage remaining the same at the terminals at the feed device, it is possible to use a lower supply voltage than in the case of known devices. Thus by virtue of the third series-connected resistor it is now possible for the voltage which occurs between the first or second terminal with respect to the third terminal to be simultaneously influenced by reducing one single resistor. That simplifies the actuating procedure as only one resistor is controlled, instead of two resistors. In addition, when reducing the ohmic resistance of the first and second resistors, care is to be taken to ensure that they always involve the same ohmic resistance during the reduction operation also, as otherwise unequal voltages occur between the first or second terminal, with respect to the third terminal. That problem is circumvented by a reduction only in the third resistor as the reduction in the ohmic resistance of the third resistor acts equally on both voltages between the first and second terminals respectively with respect to the third terminal. In that way interference caused by unequal voltages at the first two terminals is effectively avoided in the transmission of the ac voltage signal to the first two terminals of the feed device so that the transmission quality of the microphone signal is not impaired.

In accordance with an aspect of the present invention the resistor arrangement of the feed device has a first and a second resistor which are arranged in mutually parallel relationship and are of the same ohmic resistance, and a third resistor arranged in series with the parallel first and second resistors.

In accordance with a further aspect of the invention the ohmic resistance of the third resistor corresponds to the ohmic resistance of the first and second resistors.

That further simplifies the feed device according to the invention as a component which is already used twice is used a further time in the circuit.

In an aspect of the invention the control device is adapted to short-circuit the third resistor.

That makes it possible to provide for an extremely simple change in the total resistance of the resistor arrangement. There is no need for a complicated and expensive circuit or change in a standard circuit to reduce the total resistance of the resistor arrangement. Only the series-connected resistor of the resistor arrangement is bridged, which can be easily effected for example by switching of a switch or an equivalent electronic component by the control device. In that way the reduction in the total resistance of the resistor arrangement can be carried out easily and reliably.

In a further aspect of the invention the measuring device determines a dc voltage between the third terminal and a node point formed by the first, second and third resistors.

The operation of determining the dc voltage between those points affords the advantage that the voltage does not have to be determined at the first two terminals but as an alternative at a location in the circuit, which is electrically closer to the feed voltage source. In that way the step of determining the voltage required for reducing the feed voltage of the dc voltage source can be carried out easily and at a low level of complication and expenditure. In addition the interference influence of measurement on the microphone signal is reduced.

In an aspect of the invention the control device is adapted to adjust the feed voltage of the dc voltage source to the value of the measured dc voltage.

In that way in accordance with the invention it is possible to set a lower dc voltage at the dc voltage source, than is possible with known feed devices, without altering the output dc voltage and thus the operating characteristics of the microphone which is fed by the feed device according to the invention.

In a further aspect of the invention the dc voltage determined by the measuring device between the first and second terminals and the third terminal and/or the dc voltage between the node point and the third terminal is stored and kept constant as long as there is no change in the microphone current.

In an aspect of the present invention the resistor arrangement represents at least one electronic circuit, in particular an electronic choke.

Thus the entire resistor arrangement can be implemented by just a single circuit. That can simplify production as the resistor arrangement can be for example in the form of an integrated component. In addition in particular assembly of the feed device according to the invention is markedly simplified as only a single component has to be assembled to produce the entire resistor arrangement.

In a further aspect of the present invention the electronic circuit has an electronic choke.

If an electronic choke is used then it is possible to use a known circuit element which is available as a standardized component for implementation of the feed device according to the invention. In that way development and also manufacturing complication and expenditure are kept low and correspondingly also the costs of the feed device according to the invention.

In an aspect of the present invention the microphone is a capacitor microphone.

The feed by means of a phantom feed is advantageously used in particular in connection with capacitor microphones as the impedance converter in the capacitor microphone can be driven by means of the feed voltage of the phantom feed. The feed voltage also serves for polarization of the capacitor converter contained in the microphone. It is therefore advantageous to use the feed device according to the invention in connection with a capacitor microphone.

The invention also concerns a method of adapting a feed voltage. In that case the method comprises the steps of determining the dc voltage between the first and second terminals and the third terminal and reducing the ohmic resistance of the resistor arrangement and the feed voltage of the dc voltage source.

In that respect it is advantageous if the feed voltage can be adapted to a dc voltage source without in that case the dc voltage being altered at the terminal of the feed device. In that way the same operating voltage is always available at the terminal of the feed device and thus the microphone, but for that purpose a lower dc voltage is necessary at the dc voltage source of the feed device, than in the case of known feed devices. In that way the power consumption of the feed device according to the invention can be reduced in comparison with known feed devices. Furthermore, the lower dc voltage within the feed device means that the voltage dropped across the feed resistors and thus the lost heat generated by the feed resistors are also reduced, whereby the corresponding cooling devices can also be of smaller dimensions, of a simpler configuration or can be completely omitted. Finally a lower power consumption within the feed device also has an effect on a lower loading and wear of the electronic components of the feed device, whereby the service life of the electronic components, the reliability of the feed device and thus user satisfaction are increased.

The invention also concerns a device, in particular a mixer desk, for feeding a multiplicity of microphones with a feed voltage, wherein a separate feed device according to the invention is provided for each microphone of the multiplicity thereof.

For that purpose there is provided for example a mixer desk which provides the feed voltages for the microphones connected to the mixer desk. If in that case a separate feed device is provided for each microphone to be fed, then different microphones can be fed with different operating properties. In that way in operation of the microphones and in the selection of the microphones to be operated, a high degree of flexibility and a great selection option are achieved as each microphone can be fed individually.

The invention also concerns a device for feeding a multiplicity of microphones with a feed voltage, wherein a common feed device according to the invention is provided for at least two microphones of the multiplicity of microphones.

With such a device which can be for example a mixer desk a plurality of microphones can be supplied with the same feed voltage, whereby, by virtue of one and the same voltage source, it is possible to ensure that the feed voltage for each microphone is the same. In addition the number of feed devices according to the invention can be reduced as each individual microphone does not require a dedicated feed device, whereby savings are made on structural space in the mixer desk and also in respect of component costs. The power consumption and also the generation of current heat losses are also reduced by the reduction in the feed devices.

In accordance with a further aspect of the present invention the common feed device for the at least two microphones is of such a configuration that, for each of the at least two microphones, the respective dc voltage between the respective first and second terminals and the respective third terminal and/or the respective dc voltage between the respective third terminal and the respective node point is to be determined, the two respectively determined dc voltages are to be compared together, and the feed voltage of the respective dc voltage source is to be adjusted to the highest dc voltage of the two determined dc voltages by means of the respective control device.

In that way for two microphones connected to the same feed device according to the invention the highest of the two voltages can be determined and set as the common feed voltage. That ensures that both microphones are supplied with the required feed voltage and in that way the operating characteristics of the microphones are not adversely affected and at the same time a reduction in the dc voltage of the dc voltage source is achieved.

The invention also concerns a microphone system having at least one feed device according to the invention for feeding a microphone, and at least one microphone.

Such a system is advantageous as the corresponding microphone can be operated with the same feed voltage as in the case of known feed devices and the operating characteristics of the microphone are not impaired, but a lower dc voltage has to be made available by the dc voltage source to afford the feed voltage in the feed device according to the invention. In that way power consumption and the current heat losses can be reduced by the feed device according to the invention without adversely affecting operation of the microphone.

BRIEF DESCRIPTION OF THE DRAWINGS

Embodiments by way of example and advantages of the present invention are described in greater detail hereinafter with reference to the following Figures:

FIG. 1 shows a diagrammatic basic circuit of a microphone with a phantom feed in accordance with DIN 61938, FIG. 2 shows a diagrammatic basic circuit of a microphone with a phantom feed in accordance with a first embodiment of the present invention.

Figure 3:
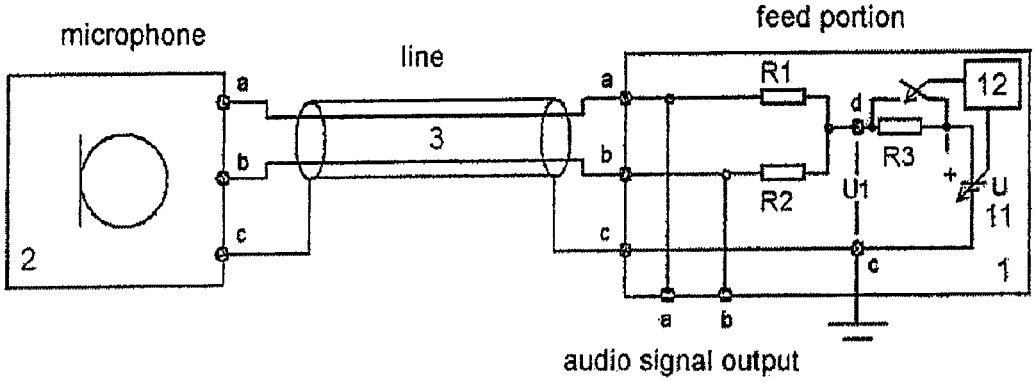
FIG. 3 shows a diagrammatic basic circuit of a microphone with a phantom feed in accordance with a second embodiment of the present invention.

The following description does not involve repetitions insofar as the components and functions of the feed device 1 according to the invention in FIGS. 2 and 3 fundamentally correspond to those of the corresponding components in FIG. 1.

DETAILED DESCRIPTION

FIG. 2 shows a diagrammatic basic circuit of a microphone, in particular a capacitor microphone, having a phantom feed 1 in accordance with the first embodiment of the present invention. The microphone 2 is connected by way of a line 3 to a feed portion 1. The configuration of the feed portion 1 in accordance with the first embodiment substantially corresponds to the configuration of the feed portion 1 in FIG. 1. The resistor R3 is not present in this case. In addition however there is a control device 12. It is so connected that the ohmic resistances of the resistors R1 and R2 as well as the voltage U of the dc voltage source 11 can be reduced by means of the control device 12. In that respect the reduction in the ohmic resistances and in the dc voltage can be effected in smoothly sliding relationship, that is to say steplessly. The change in the ohmic resistances and the dc voltage can also be in a stepped fashion as an alternative thereto. A continuous reduction avoids jumps in the values of the ohmic resistances and the dc voltage as such jumps can lead to excitations in pulse form of interference signals at the terminals a, b and c. In addition the feed device 1 according to the invention has a measuring device (not shown) by means of which the respective dc voltage between the first terminal a or the second terminal b and the third terminal c is detected.

To reduce the feed voltage firstly the microphone 2 is operated under standard conditions, that is to say it is supplied by the feed device 1 according to the invention with the standard feed voltage U. In that case the standard ohmic (output) resistances are set at the two resistors R1 and R2. With that circuit which corresponds to the circuit of FIG. 1 by virtue of the values of the two resistors R1 and R2, the operating voltage of the microphone 2 is determined. That can be effected for example at the output of the feed side between the terminals a and b and the reference potential c (ground) by means of the measuring device.

In a second step the standard ohmic (output) resistances of the feed resistors R1 and R2 are reduced. At the same time the feed voltage U is reduced to the same extent in such a way that once again the result is the above-ascertained operating voltage at the microphone 2. As a result the feed conditions of the microphone 2 are not changed, but the power loss in the feed resistors R1 and R2 is reduced, more specifically correspondingly more, the lower the resistances of the feed resistors R1 and R2 are selected to be.

The transition from the standard mode of operation to the mode of operation that is modified in accordance with the invention can be effected in a sliding fashion so that no troublesome or interference effects occur during the transition from the original ohmic resistances of the feed resistors R1 and R2, to the reduced ohmic resistances.

In that respect it is equally possible for the ohmic resistances of the resistors R1 and R2 as well as the voltage U of the dc voltage source 11 to be increased by means of the control device 12. That may be necessary if the same feed device according to the invention is to be used to operate a different microphone 2 than the microphone 2 for which a reduction in the dc voltage U of the dc voltage source 11 was already effected. So that the feed device 1 according to the invention can be adapted to different microphones 2 the above-described procedure for ascertaining the reduced dc voltage is to be repeated for each microphone 2 in order not to impair the respective operation of different microphones 2.

That procedure is required when the feed device is brought into operation and after each change in the current flow as occurs due to being brought into operation or due to a change in a microphone. That can be effected automatically.

Therefore the control device 12 must be capable of increasing the reduced ohmic resistances of the resistors R1 and R2 and the voltage U of the dc voltage source 11 to standard values prior to the reduction again in order to restore the initial condition from which the above-described procedure for reducing those values is effected.

In addition to the two resistors R1 and R2 a further resistor R3 can be provided in series in the diagrammatic basic circuit of FIG. 2, the ohmic resistance of the resistor R3 being reduced, as in the case of the resistors R1 and R2, by the control device 12. That affords the possibility of influencing the total ohmic resistance of the resistor arrangement R1, R2 and R3. In that respect all three resistors R1, R2 and R3 can be actuated and reduced by the control device 12 at the same time or independently of each other. In that respect however care is to be taken to ensure that the resistors R1 and R2 always involve the same ohmic resistances to avoid interference at the terminals a, b. The ohmic resistance of the third resistor R3 can also be not only reduced but also increased by means of the control device 12.

FIG. 3 shows a diagrammatic basic circuit of a microphone having a phantom feed in accordance with a second embodiment of the invention. The microphone 2 is connected to the feed portion 1 by way of a line 3. The feed portion in FIG. 3 substantially corresponds to the feed portion in FIG. 1. In addition thereto however there is a control device 12.

In this case the reduction in the ohmic resistance of the resistor arrangement R1, R2 and R3 is effected by short-circuiting of the third resistor R3 by the control device 12. In that case the dc voltage U of the dc voltage source 11 is adapted by the control device 12 to the reduced overall ohmic resistance of the resistor arrangement R1, R2 and R3. In that case interference can be caused at the terminals a and b in this embodiment by the abrupt change. The interference can be prevented by the insertion of an additional filter member comprising a resistor and a capacitor, at the node point between R1, R2 and R3. The diagrammatic basic circuit in this embodiment is of a simpler structure than that of the first embodiment and does not require actuation of the individual resistors R1, R2 and R3 as the resistors R1, R2 and R3 are not altered but only the resistor R3 is short-circuited. That means that the complication and expenditure involved in actuation is reduced in comparison with the first embodiment, the standard circuit can be used unchanged and there is no need for control lines from the control device 12 to the resistors R1, R2 and R3.

A possible implementation of the concept according to the invention will now be described by way of example with reference to the phantom feed at 48 V.

In accordance with the standard DIN 61938 the feed resistors R1 and R2 are each of an ohmic resistance of 6.8 kΩ, see Table 1. The feed resistors R1 and R2 are now replaced for example by two resistors with ohmic resistances of 2.2 kΩ in each case. In addition a third resistor R3 with also an ohmic resistance of 2.2 kΩ is connected between the node point d of the two resistors R1 and R2 and the feed voltage source 11 so that the third resistor R2 has the entire operating current of the feed device 1 and therewith also the microphone 2 flowing therethrough, see FIG. 3. That resistor arrangement is practically equivalent in terms of direct current to the standard resistor arrangement shown in FIG. 1. In principle that equivalence applies for the resistances R1, R2, R3 involving the following dimensioning:

$$0.5\times(R1+R2)+2\times R3=6.8\ \text{k}\Omega$$

Firstly the dc voltage U1 between the node point d of the three resistors R1, R2 and R3 and the third terminal c of feed device 1 is ascertained. The third resistor R3 is then short-circuited and at the same time the dc voltage U of the feed voltage source 11 is set to the previously ascertained, lower voltage U1. In this case it is not the voltage at the microphone 2 that is measured, but as a replacement the voltage is measured at a location in the circuit, the node point d, which is electrically closer to the feed voltage source 11. As however the circuit between the microphone 2 and that node point d does not change by virtue of the short-circuiting of the third resistor R3, the operating conditions of the microphone 2 also remain unchanged, with the total power of the feed voltage source 11 being reduced. If the microphone 2 consumes for example the maximum current of 10 mA which is permissible in accordance with the standard, the voltage U of the feed voltage source 11 can be reduced from 48 V by 22 V to 26 V. In that way the total power to be applied by the voltage source 11 is reduced from 0.48 W to 0.26 W and is thus almost halved.

If the ohmic resistances of the resistors R1 and R2 are selected to be even lower, the power balance sheet can then be further improved. It is to be noted however that the loading on the microphone 2 by the resistors R1 and R2 does not become too great. In the case given by way of example the load resistance is 4.4 kΩ (=R1+R2). In most cases that value still does not represent an inadmissible loading on the microphone 2.

In accordance with the invention the lower dc voltage, within the feed device, also makes it possible to reduce the voltage dropped across the feed resistors and thus the loss heat generated by the feed resistors. A lower level of heat in the feed device also makes it possible for the cooling devices to be of smaller dimensions, which are required for dissipation of the loss heat generated by the electronic components in the feed device. In that respect passive elements such as cooling members are considered as the cooling devices, such cooling members for example by means of ribs contributing to an increase in the contact area with the ambient air and thus promoting transportation of the loss heat away from the device by air cooling. On the other hand it is also possible to use active cooling means in a feed device, which include fans as well as fluid circuits. If a lower level of loss heat is generated by virtue of a lower dc voltage the cooling devices can be of smaller dimensions, they can be of a simpler configuration or they can be completely omitted. In that way it is possible to reduce costs directly by virtue of lower material and assembly costs for the cooling elements as well as the structural space of the feed device, the reduction in which can indirectly lead to further cost reductions.

Finally a reduced loss power within the feed device also has an effect on a lower level of loading and wear of the electronic components of the feed device. That increases the service life of the electronic components whereby less damage and failures of the feed device occur at the same time. That results in lower material and working costs for repairs and when replacing a feed device, the electronic components of which have been worn out by the direct current and thus damaged or destroyed. In addition fewer failures also lead to a higher degree of reliability of the feed device and thus a higher level of user satisfaction.

Adjusting the feed voltage in accordance with the invention to the value of the measured dc voltage provides that the voltage of the dc voltage source is adjusted to the previously determined value of the feed voltage at the terminals of the feed device so that, with the reduced voltage of the dc voltage source, the same voltage value is also set at the microphone to be fed. In addition in that way one and the same component within the feed device according to the invention is possible for reducing both the total resistance also the feed voltage. That avoids time delays occurring between the one reduction in the total resistance and the other reduction in the feed voltage. A time delay is to be avoided as, in the time in which the total resistance is already lowered, the previous feed voltage is however still applied and is fed to the microphone by way of the lines. That can lead to disturbances in operation and in the transmission of the microphone signal, if not even damage to the microphone. Therefore time congruence is important for adjustment of the feed device according to the invention. That can be achieved by the unitary reduction both in the total resistance and also the feed voltage, by the control device. In addition that dispenses with further electronic components which would make the circuit of the feed device more complicated and expensive.

In accordance with a further aspect of the present invention the measuring device and/or the control device are in the form of an integrated circuit. In addition the integrated circuit is a processor with integrated analog-digital converter. Finally the feed voltage of the dc voltage source is produced by means of a dc voltage transformer or a switching mains power supply from a supply voltage of the feed device. In that way various functions of the feed device according to the invention can be implemented in integrated circuits and a plurality of functions can also be combined in one component. It is possible to use standardized and thus inexpensive and tried-and-tested components, whereby the manufacturing costs for a feed device according to the invention are reduced and the reliability thereof is improved.

The invention claimed is:

1. A feed device for feeding a microphone, in particular a capacitor microphone, with a direct current (DC) voltage, comprising:

a first, a second and a third terminal;

a resistor arrangement comprising at least a first resistor;

a DC voltage source for providing a feed voltage, wherein the resistor arrangement is disposed directly between the DC voltage source and the first and second terminals for reducing the power consumption of the feed device;

a measuring device for detecting a first DC voltage between the first and second terminals and the third terminal; and a control device for reducing or increasing the ohmic resistance of the resistor arrangement and/or the feed voltage of the DC voltage source, based on said detected first DC voltage.

2. A feed device as set forth in claim 1 wherein the resistor arrangement has the first resistor and a second resistor which are arranged in mutually parallel relationship and involve the same ohmic resistance, and wherein the control device is adapted to slidingly reduce or increase the ohmic resistances of the first and second resistors.

3. A feed device as set forth in claim 2 wherein the resistor arrangement corresponds to the standard DIN 61938.

4. A feed device as set forth in claim 1 wherein the resistor arrangement has the first resistor and a second resistor which are arranged in mutually parallel relationship and involve the same ohmic resistance, and has a third resistor arranged in series with the first and second resistors.

5. A feed device as set forth in claim 4 wherein the ohmic resistance of the third resistor equals the ohmic resistance of the first and second resistors.

6. A feed device as set forth in claim 4 wherein the control device is adapted to short-circuit the third resistor.

7. A feed device as set forth in claim 4 wherein the measuring device is adapted to determine the first DC voltage which is applied between the third terminal and a node point formed by the first, second and third resistors.

8. A feed device as set forth in claim 7 wherein the control device is adapted to adjust the feed voltage of the DC voltage source to the value of the measured first DC voltage.

9. A feed device as set forth in claim 7 wherein the first DC voltage and/or the DC voltage between the node point and the third terminal is stored.

10. A feed device as set forth in claim 1 wherein the resistor arrangement represents at least one electronic circuit, in particular an electronic choke.

11. A feed device as set forth in claim 1 wherein the microphone is a capacitor microphone.

12. A method of adapting a feed voltage of a feed device for the feed of a microphone with a DC voltage, wherein the feed device has a first, second and third terminal, a resistor arrangement having at least one resistor, a DC voltage source for providing a feed voltage, the resistor arrangement being disposed directly between the DC voltage source and the first and second terminals for reducing the power consumption of the feed device, a measuring device for detecting the DC voltage between the first and second terminals and the third terminal, and a control device, wherein the method comprises the following steps:

determining the DC voltage between the first and second terminals and the third terminal; and reducing or increasing the ohmic resistance of the resistor arrangement, by said control device, between the DC voltage source and the first and second terminals and the feed voltage of the DC voltage source by the control device, based on said detected DC voltage.

13. A device, in particular a mixer desk, for feeding a multiplicity of microphones with a feed voltage, wherein provided for each microphone of the multiplicity of microphones is a separate feed device as set forth in claim 1.

14. A device, in particular a mixer desk, for feeding a multiplicity of microphones with a feed voltage, wherein provided for at least two microphones of the multiplicity of microphones is a feed device, comprising a common feed device, as set forth in claim 1.

15. A device as set forth in claim 14 wherein the common feed device of the at least two microphones is adapted for each of the at least two microphones to determine the DC voltage between the first and second terminals and the third terminal and/or the DC voltage between the third terminal and the node point, to compare the two respectively determined DC voltages together, and by means of the control device to adjust the feed voltage of the DC voltage source to the highest DC voltage of the two determined DC voltages.

16. A microphone system comprising:

at least one feed device for feeding a microphone as set forth in claim 1; and at least one microphone.

* * * * *

UNITED STATES PATENT AND TRADEMARK OFFICE

CERTIFICATE OF CORRECTION

PATENT NO. : 8,379,896 B2
APPLICATION NO. : 12/773643
DATED : February 19, 2013
INVENTOR(S) : Hibbing et al.

It is certified that error appears in the above-identified patent and that said Letters Patent is hereby corrected as shown below:

In the Abstract:

On the Title page, second column, at item (57), second line of Abstract, please delete "dc" and insert --DC--.

On the Title page, second column, at item (57), fourth line of Abstract, please delete "dc" and insert --DC--.

On the Title page, second column, at item (57), fifth line of Abstract, after "In that case", please insert a --,--.

On the Title page, second column, at item (57), sixth line of Abstract, please delete "dc" and insert --DC--.

On the Title page, second column, at item (57), seventh line of Abstract, after "In addition", please insert a --,--.

On the Title page, second column, at item (57), ninth line of Abstract, please delete "dc" and insert --DC--.

On the Title page, second column, at item (57), twelfth line of Abstract, please delete "dc" and insert --DC--.

In the Specification:

In column 1, line 10, please delete "electrical ac" and insert --electrical AC--.

In column 1, line 10, please delete "Those ac" and insert --Those AC--.

In column 1, line 12, please insert a --,-- after the word "lines".

In column 1, line 13, please insert a --,-- after the word "example".

Signed and Sealed this
Eleventh Day of June, 2013

Teresa Stanek Rea

Teresa Stanek Rea
*Acting Director of the United States Patent and Trademark Office*

In the Specification:

In column 1, line 16, please insert a --,-- after the word “purpose”.

In column 1, line 16, please delete “dc” and insert --DC--.

In column 1, line 17, please delete “ac” and insert --AC--.

In column 1, line 19, please insert a --,-- after the word “microphones”.

In column 1, line 19, please delete “referred” and insert --referred to--.

In column 1, line 21, please insert a --,-- before and after the term “inter alia”.

In column 1, line 26, please insert a --,-- after the word “respect”.

In column 1, line 29, please delete “ac” and insert --AC--.

In column 1, line 31, please delete “ac” and insert --AC--.

In column 1, line 36, please insert a --,-- after “portion 1”.

In column 1, line 36, please delete “dc” and insert --DC--.

In column 1, line 37, please insert a --,-- after “respect”.

In column 1, line 38, please delete “dc” and insert --DC--.

In column 1, line 39, please delete “dc” and insert --DC--.

In column 1, line 48, please insert a --,-- after “way”.

In column 1, line 52, please insert a --,-- after “case”.

In column 1, line 55, please delete “ac” and insert --AC--.

In column 1, line 59, please insert a --,-- after “addition”.

In column 1, line 66, please insert a --,-- after “practice”.

In column 2, line 11, please insert a --,-- after “loss”.

In column 2, line 27, please insert a --,-- after “Also”.

In column 2, line 39, after “voltage” please delete the “,”.

In column 2, line 48, please insert a --,-- after “device”.

In column 2, line 48, please insert a --,-- after “invention”.

In column 2, line 51, please insert a --,-- after “way”.

In the Specification:

In column 2, line 55, please insert a --,-- after “way”.

In column 2, line 56, please insert a --,-- after “device”.

In column 2, line 56, please insert a --,-- after “invention”.

In column 2, line 59, please insert a --,-- after “invention”.

In column 3, line 1, please insert a --,-- after “case”.

In column 3, line 5, please insert a --,-- after “particular”.

In column 3, line 12, please insert a --,-- after “invention”.

In column 3, line 15, please insert a --,-- after “Thus”.

In column 3, line 18, please insert a --,-- after “invention”.

In column 3, line 25, after “two resistors” please insert a --,--.

In column 3, line 27, please insert a --,-- after “case”.

In column 3, line 31, please insert a --,-- after “Thus”.

In column 3, line 45, please insert a --,-- before and after “respectively”.

In column 3, line 46, please insert a --,-- after “way”.

In column 3, line 48, please delete “ac” and insert --AC--.

In column 3, line 51, please insert a --,-- after “invention”.

In column 3, line 56, please insert a --,-- after “invention”.

In column 3, line 59, please insert a --,-- after “device”.

In column 3, line 60, please insert a --,-- after “invention”.

In column 3, line 60, after “used twice” please insert --and--.

In column 3, line 62, please insert a --,-- after “invention”.

In column 4, line 3, please insert a --,-- before and after “for example”.

In column 4, line 4, please insert a --,-- after “way”.

In column 4, line 7, please insert a --,-- after “invention”.

In column 4, line 14, please insert a --,-- after “way”.

In the Specification:

In column 4, line 17, please insert a --,-- after “addition”.

In column 4, line 19, please insert a --,-- after “invention”.

In column 4, line 22, please insert a --,-- after “way”.

In column 4, line 27, please insert a --,-- after “invention”.

In column 4, line 32, please insert a --,-- after “invention”.

In column 4, line 38, please insert a --,-- after “addition”.

In column 4, line 42, please insert a --,-- after “invention”.

In column 4, line 46, please insert a --,-- after “device”.

In column 4, line 47, please insert a --,-- after “way”.

In column 4, line 51, please insert a --,-- after “invention”.

In column 4, line 59, please insert a --,-- after “device”.

In column 4, line 59, please insert a --,-- after “invention”.

In column 4, line 62, please insert a --,-- after “case”.

In column 5, line 1, please insert a --,-- after “respect”.

In column 5, line 4, please insert a --,-- after “way”.

In column 5, line 8, please insert a --,-- after “way”.

In column 5, line 12, please insert a --,-- before “and”.

In column 5, line 14, please insert a --,-- after “configuration”.

In column 5, line 15, please insert a --,-- after “Finally”.

In column 5, line 26, please insert a --,-- after “purpose”.

In column 5, line 31, please insert a --,-- after “way”.

In column 5, line 39, please insert a --,-- after “device”.

In column 5, line 39, please insert a --,-- before and after “for example”.

In column 5, line 43, please insert a --,-- after “addition”.

In column 5, line 50, please insert a --,-- after “invention”.

In the Specification:

In column 5, line 62, please insert a --,-- after “way”.

In column 5, line 63, please insert a --,-- after “device”.

In column 5, line 63, please delete “according to the invention”.

In column 6, line 13, please insert a --,-- after “way”.

In column 6, line 40, please insert a --,-- after “feed 1”.

In column 6, line 43, please insert a --,-- after “portion 1”.

In column 6, line 43, please insert a --,-- after “embodiment”.

In column 6, line 45, please insert a --,-- after “addition”.

In column 6, line 46, please delete “however”.

In column 6, line 47, please insert a --,-- after “R2”.

In column 6, line 48, please insert a --,-- after “11”.

In column 6, line 49, please insert a --,-- after “respect”.

In column 6, line 57, please insert a --,-- after “addition”.

In column 6, line 61, please insert a --,-- after “voltage”.

In column 6, line 63, please insert a --,-- after “device 1”.

In column 6, line 63, please insert a --,-- after “invention”.

In column 6, line 64, please insert a --,-- after “case”.

In column 7, line 2, please insert a --,-- before and after “for example”.

In column 7, line 9, please insert a --,-- after “result”.

In column 7, line 20, please insert a --,-- after “respect”.

In column 7, line 27, please insert a --,-- after “device 1”.

In column 7, line 28, please insert a --,-- after “invention”.

In column 7, line 28, please insert a --,-- after “microphones 2”.

In column 7, line 36, please insert a --,-- after “Therefore”.

In column 7, line 48, please insert a --,-- after “respect”.

In the Specification:

In column 7, line 50, please insert a --,-- before and after “however”.

In column 7, line 57, please insert a --,-- after “feed”.

In column 7, line 61, please insert a --,-- before and after “however”.

In column 7, line 62, please insert a --,-- after “case”.

In column 7, line 65, please insert a --,-- after “case”.

In column 8, line 1, please insert a --,-- after “case”.

In column 8, line 15, please insert a --,-- after “concept”.

In column 8, line 16, please insert a --,-- after “invention”.

In column 8, line 18, please insert a --,-- after “61938”.

In column 8, line 19, please delete “6.8 kΩ, see” and insert --6.8 kΩ (see--.

In column 8, line 20, please delete “Table 1” and insert --Table 1)--.

In column 8, line 20, please insert a --,-- after “replaced”.

In column 8, line 21, please insert a --,-- after “example”.

In column 8, line 22, please insert a --,-- after “addition”.

In column 8, line 29, please insert a --,-- after “principle”.

In column 8, line 34, please insert a --,-- after “Firstly”.

In column 8, line 39, please insert a --,-- after “case”.

In column 8, line 42, please insert a --,-- before and after “however”.

In column 8, line 48, please insert a --,-- after “10 mA”.

In column 8, line 51, please insert a --,-- after “way”.

In column 8, line 52, please insert a --,-- after “0.26 W”.

In column 8, line 58, please insert a --,-- after “example”.

In column 8, line 62, please insert a --,-- after “invention”.

In column 8, line 62, please delete “dc” and insert --DC--.

In column 8, line 62, please delete the “,” after “voltage”.

In the Specification:

In column 8, line 63, please delete the "," after "device".

In column 9, line 2, please insert a --,-- after "respect".

In column 9, line 4, please insert a --,-- before and after "for example".

In column 9, line 7, please insert a --,-- after "hand".

In column 9, line 25, please insert a --,-- after "addition".

In column 9, line 28, please insert a --,-- after "voltage".

In column 9, lines 28-29, please insert a --,-- after "invention".

In column 9, line 34, please insert a --,-- after "addition".

In column 9, line 44, please insert a --,-- after "Therefore".

In column 9, line 45, please insert a --,-- after "device".

In column 9, line 48, please insert a --,-- after "addition".

In column 9, lines 48-49, please insert a --,-- after "components".

In column 9, line 51, please insert a --,-- after "invention".

In column 9, line 53, please insert a --,-- after "addition".

In column 9, line 54, please insert a --,-- after "Finally".

In column 9, line 57, please insert a --,-- after "way".

In column 9, line 58, please insert a --,-- after "device".

In column 9, line 58, please insert a --,-- after "invention".

In column 9, line 62, please insert a --,-- after "device".

In column 9, line 63, please insert a --,-- after "invention".